US007331153B1

(12) United States Patent
Sperry et al.

(10) Patent No.: US 7,331,153 B1
(45) Date of Patent: Feb. 19, 2008

(54) APPARATUS AND METHOD FOR CREATING EASY TO OPEN PACKAGES

(75) Inventors: Laurence Sperry, Newton, MA (US); Mario V. DiVasta, Chelsea, MA (US); Brian A. Murch, Needham, MA (US)

(73) Assignee: Sealed Air Corporation (US), Saddle Brook, NJ (US)

( * ) Notice: Subject to any disclaimer, the term of this patent is extended or adjusted under 35 U.S.C. 154(b) by 0 days.

(21) Appl. No.: 11/469,161

(22) Filed: Aug. 31, 2006

(51) Int. Cl.
*B65B 61/18* (2006.01)
*B65B 9/02* (2006.01)

(52) U.S. Cl. ..... 53/133.3; 53/133.7; 53/553; 53/74

(58) Field of Classification Search ..... 53/133.3, 53/133.5, 133.6, 133.7, 133.8, 412, 450, 53/452, 545, 548, 553, 57, 58, 74; 493/212, 493/923, 930
See application file for complete search history.

(56) References Cited

U.S. PATENT DOCUMENTS

| | | | | |
|---|---|---|---|---|
| 3,566,752 | A | 3/1971 | Dreher | |
| 3,570,751 | A | 3/1971 | Trewella | |
| 3,641,732 | A * | 2/1972 | Fujio | 53/412 |
| 3,642,126 | A | 2/1972 | Kurtz et al. | |
| 3,766,707 | A | 10/1973 | Alexander | |
| 3,795,080 | A * | 3/1974 | Smolderen et al. | 53/133.7 |
| 3,943,809 | A | 3/1976 | Schoppee et al. | |
| 4,125,985 | A * | 11/1978 | Laske | 53/133.3 |
| 4,157,759 | A | 6/1979 | Dicker | |
| 4,185,443 | A | 1/1980 | Budzyn | |
| 4,498,274 | A | 2/1985 | Vorhauer | |
| 4,725,329 | A * | 2/1988 | Tani | 53/412 |
| 4,767,391 | A * | 8/1988 | Jensen | 493/923 |
| 5,035,517 | A | 7/1991 | Edelman | |
| 5,071,399 | A | 12/1991 | Ashby | |
| 5,114,243 | A | 5/1992 | Thier | |
| 5,163,612 | A | 11/1992 | Ashby | |
| 5,179,815 | A | 1/1993 | Cahill et al. | |
| 5,248,082 | A | 9/1993 | Elmlinger | |
| 5,499,740 | A | 3/1996 | Huck et al. | |
| 5,651,235 | A | 7/1997 | Ashley et al. | |
| 5,669,551 | A | 9/1997 | Sigloch | |
| 5,899,336 | A | 5/1999 | Kataoka | |
| 6,354,739 | B1 | 3/2002 | Sheehan, Jr. et al. | |
| 6,513,657 | B2 | 2/2003 | Sheehan, Jr. | |

(Continued)

OTHER PUBLICATIONS

*Ids Packaging—White Paper*, available at http://www.idspackaging.com/Common/Paper/Paper_59/Advances%20in%20Easy%20Opening%20Technology.htm, (Aug. 21, 2006), 9 pages.

*Primary Examiner*—Louis Huynh
(74) *Attorney, Agent, or Firm*—Alston & Bird LLP

(57) ABSTRACT

A product packaging apparatus that includes a notch former and a tab setter for creating an integrated tab on a product package. The notch former and tab setter are capable of forming a tab or an exposed area at any location of the product package, including creating a tab or an exposed area adjacent a longitudinal edge of the package. The notch former and the tab setter allow a tab to be created that has a length that extends beyond the longitudinal edge of the package. As a result, the present invention is capable of generating simple, easy to open packages that may also be re-used for re-mailing purposes.

6 Claims, 10 Drawing Sheets

U.S. PATENT DOCUMENTS

| | | | | |
|---|---|---|---|---|
| 6,557,609 | B1 | 5/2003 | Fini et al. | |
| 6,895,732 | B2 | 5/2005 | Sperry et al. | |
| 6,971,221 | B2 | 12/2005 | Sperry et al. | |
| 2001/0000480 | A1 | 4/2001 | Stagg et al. | |
| 2002/0184857 | A1 | 12/2002 | O'Connor et al. | |
| 2003/0053720 | A1* | 3/2003 | Smith et al. | 493/212 |
| 2003/0174909 | A1 | 9/2003 | Parra | |
| 2006/0126975 | A1 | 6/2006 | McKellar | |

* cited by examiner

TEAR DIRECTION
238
234
239
P
234
100

B
A
TEAR DIRECTION
233
236

P
240

REMOVE PRODUCT
INSERT PRODUCT
242
100
242

APPARATUS AND METHOD FOR CREATING EASY TO OPEN PACKAGES

FIELD OF THE INVENTION

The present invention relates to machines and methods for packaging objects using flexible or semi-flexible sheet materials, wherein an object is disposed between two portions of sheet material and the two portions are sealed together about the periphery of the object to form a package.

BACKGROUND OF THE INVENTION

Flexible packaging has long been used to package products such as books, compact discs, cassette tapes, and a host of other types of objects to provide protection when shipping or mailing the objects, and in some cases to hermetically seal the objects from the outside environment. Web-handling machines have been developed to automate the process of packaging objects in flexible packaging materials. Dual-web machines bring a pair of webs into generally parallel confronting relation with each other and feed a product, or a group of products, between the webs. At a downstream sealing station the webs are sealed together around the products(s), thus forming a package containing the product(s). The package is severed from the remainder of the webs to complete the process. Single-web machines work similarly, except a single web is either supplied to the machine as a C-fold, or a flat web is manipulated and folded into a C-fold configuration, the objects to be packaged are inserted between the two opposing portions of the C-folded web, and one longitudinal seal and two cross seals are formed.

Web-handling machines are typically configured to operate in a continuous mode or a manual mode. In the continuous mode, a web-handling machine constantly runs and drives webs of material from supply rolls through a nipping station, thus packaging any product that is placed between the webs. The continuous mode is often used when there is a continuous stream of products being placed between the webs to be packaged. Usually the continuous stream of products is delivered via an automatic conveying system. Conversely, in the manual mode, an operator typically engages a selector switch, such as a cycle button. By activating the cycle button, the machine is caused to operate through one cycle, wherein one product or set of products and portions of both webs are advanced through the nipping station to form a package. For example, packaging machines of a similar type are disclosed in U.S. Pat. Nos. 6,895,732 and 6,971,221, assigned to Sealed Air Corporation.

One previous drawback of some web-handling machines was material waste due to a break in a continuous stream of products when operating in the continuous mode or due to operator error when operating in the manual mode. A second drawback was inadequate sealing at the edges caused by misalignment of the product. More recent web-handling machines have incorporated infeed gates and product detectors for detecting the presence or absence of a product to be packaged, the length of the product, and the height of the product. These infeed gates and product detectors were incorporated to solve the aforementioned problems. For example, an infeed gate orients the leading edge of the package in a parallel plane with the nipping station, thus locating the product in the proper orientation and improving the quality of the seal because the product is not skewed toward one of the sealing edges. Additionally, the infeed gate and product detectors also provide a control unit with a signal indicating the absence or presence of a product and the location of the product, allowing the control unit to begin or end the supply of web material, thereby reducing waste material. When a product is detected the infeed gate is lifted allowing the product to advance through the nipping station. Simultaneously, the web material is advanced and then sealed to form a package around the product. When no product is detected, the process is halted.

Even with the incorporation of infeed gates and product detectors, typical web-handling machines produce only standard packages and lack the ability to add special features to the packaging, such as features for ease of opening, aesthetic value, or re-use of the packaging.

As a result, there remains a need for a device for incorporation into a product packaging system that is capable of facilitating additional features to the packaging that will improve the ease of opening, aesthetic value, and re-use of the packaging. The device should be relatively simple and should be adaptable for incorporating into existing web-handling systems.

BRIEF SUMMARY OF THE INVENTION

The present invention addresses the above needs and achieves other advantages by providing an automated product packaging apparatus and method that include a notch former and a tab setter for creating an integrated tab or an exposed area on a product package. By incorporating the tab or the exposed area into the packaging material, the apparatus and method of the present invention increase the ease of opening and aesthetic features of the package. Additionally, the apparatus and method of the present invention are capable of creating a tab with a length that extends beyond an edge of the package. This creates a simple, easy to open package that may also be re-used for re-mailing purposes.

In one embodiment, the present invention includes a packaging station, a web drive system, a cutoff device, a notch former, and a tab setter. The packaging station comprises a nip through which first and second webs with a product disposed therebetween are advanced in a longitudinal direction such that the webs are adhered to each other and envelop the product. The web drive system is operable to advance the first and second webs to the packaging station. The cutoff device is located downstream from the packaging station and is structured to sever the adhered webs so as to create the package containing the product. The notch former is located upstream from the cutoff device and adjacent at least one of the first or second webs. The notch former is structured to create a notch having a free end in at least one of the webs. The tab setter is located between the notch former and the cutoff device and is structured to fold the free end of the notch back against the web before advancing through the cutoff device, thus forming a notch on the web that becomes a tab on the package for facilitating opening the package.

In another embodiment, the notch former may be located adjacent the first web and upstream from the packaging station such that the notch is formed in the first web. In still another embodiment, the notch former may comprise a linearly actuateable notch blade located adjacent and on one side of at least one of the first or second webs, and a blade striking member located adjacent and on the other side of the web such that the notch is created by actuating the notch blade toward the blade striking member. In still another embodiment, the tab setter comprises a biasing member structured to bias the free end of the notch to one side of the web, a deflecting member structured to rotate the free end of the notch to a position in which the free end is directed in an approximate upstream direction and substantially adjacent the web as the web is advanced, and a flattening member structured to flatten the notch against the web as the web is advanced. The apparatus can comprise an infeed gate mechanism located adjacent the second web and upstream from the packaging station, and a controller for controlling the web drive system, the infeed gate mechanism, the notch former, and the cutoff device. The infeed gate mechanism is structured to move between a blocking position for accurately positioning a leading edge of the product on the second web, and an unblocking position for allowing the product to travel with the second web to the packaging station. The controller can control the web drive system, the infeed gate, the notch former, and the cutoff device such that at least a portion of the tab extends beyond an edge of the package.

In another embodiment, the present invention provides a method of creating an easy to open package containing a product. The method comprises providing first and second continuous webs of flexible packaging material, placing a product on at least one of the first or second webs, advancing the first and second webs and the product toward and through a nip at a packaging station using a web drive system, creating a notch or a cutout area in at least one of the first or second webs using a notch former, adhering the first and second webs to each other and around the product such that the webs envelop the product at the packaging station, and severing the adhered webs using a cutoff device to form the easy to open package that includes a tab formed from the notch, or an exposed area created by the cutout area.

The step of creating a notch comprises actuating a notch blade located adjacent and on one side of at least one of the first or second webs toward a blade striking member located adjacent and on the other side of the web to create a notch having a free end, biasing the free end of the notch to a first side of the web using a biasing member as the web is advanced, deflecting the free end of the notch using a deflecting member such that it rotates to a position in which the free end is directed in an approximate upstream direction and substantially adjacent the web as the web is advanced, and flattening the notch downstream against the web with a flattening member as the web is advanced. The step of creating a cutout area comprises actuating a notch blade located adjacent and on one side of at least one of the first or second webs toward a blade striking member located adjacent and on the other side of the web to create a cutout area. In still another embodiment, the step of placing a product on at least one of the first or second webs comprises placing a product on the second web and against an infeed gate mechanism that accurately positions a leading edge of the product, and the step of advancing the first and second webs and the product comprises controlling the infeed gate mechanism to move from a blocking position to an unblocking position and controlling the web drive system to advance the first and second webs and product to the packaging station. In still another embodiment, the steps of creating a notch or creating a cutout area and severing the adhered webs further comprise controlling the notch former in conjunction with the web drive system and the infeed gate mechanism using the controller such that at least a portion of a tab formed from the notch extends beyond an edge of the package or such that an exposed area created by the cutout area is adjacent an edge of the package.

In another embodiment the present invention provides an easy to open package containing a product, the package comprising first and second webs constructed of a flexible packaging material, the webs defining facing surfaces, wherein each of the webs includes a layer of cohesive on at least a portion of its facing surface, the cohesive being sealable to itself by application of pressure alone, the webs being adhered to each other and enveloping the product, and wherein a tab is formed in at least one of the first web or the second web. In another embodiment, a cutout area may be formed in one of the first web or the second web that creates an exposed area in the other web when adhered. The package may further define at least one longitudinal edge and a tab may have a length that extends beyond the longitudinal edge or an exposed area may be adjacent the longitudinal edge. The package may further define at least one transverse edge and a tab or an exposed area may be adjacent the transverse edge and may further be adjacent the longitudinal edge and the transverse edge. The package may further comprise at least one perforation line extending from a tab or exposed area and the tab or the exposed area may create a tear strip. In still another embodiment, the package defines at least a downstream longitudinal edge and a pair of transverse edges, and a tab or an exposed area is formed adjacent the downstream longitudinal edge and one of the transverse edges, such that the tab or the exposed area creates a tear strip that, once removed, also allows the package to be used as a re-mailing package.

BRIEF DESCRIPTION OF THE DRAWINGS

Figures 1, 2:
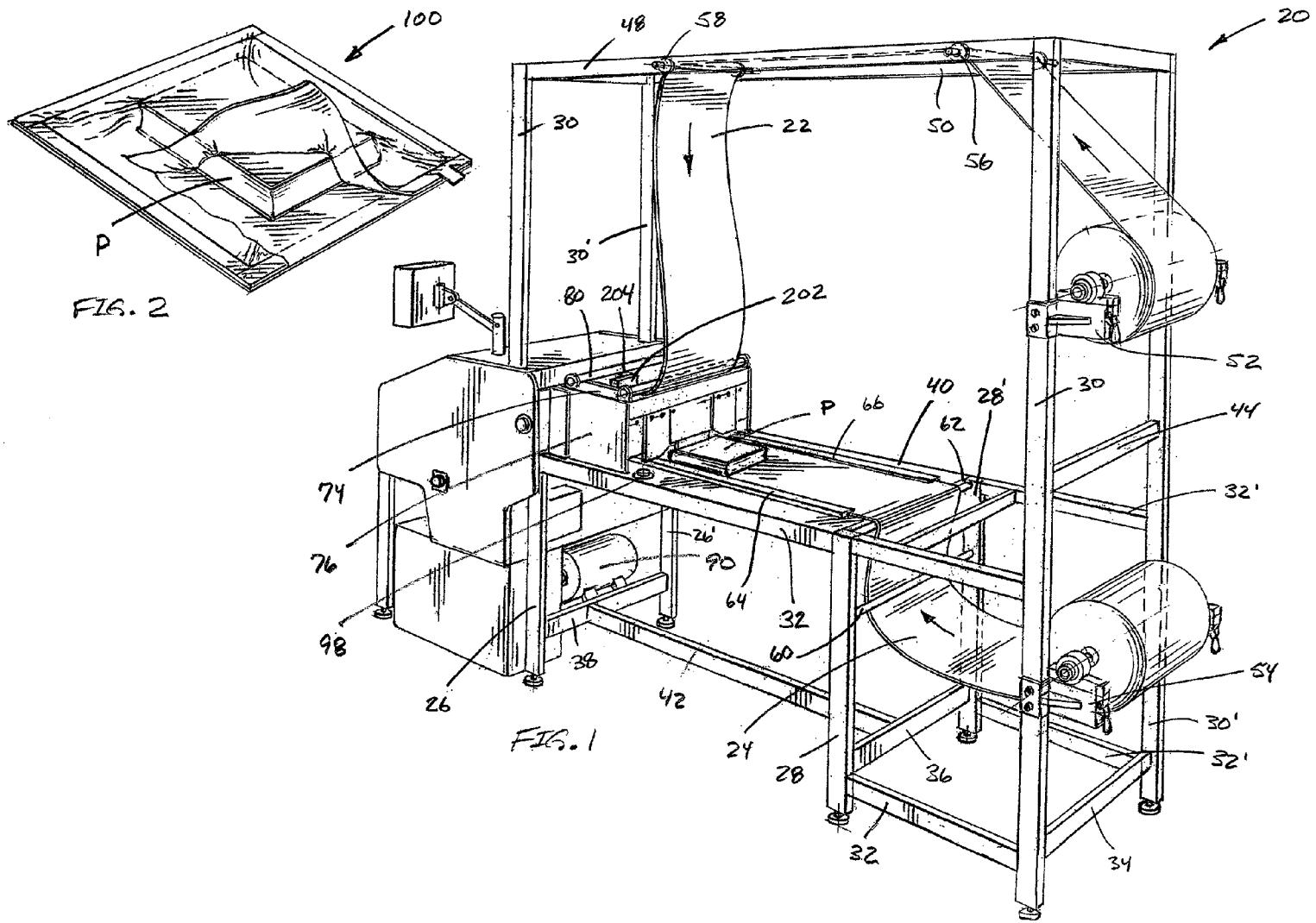
Figure 3:
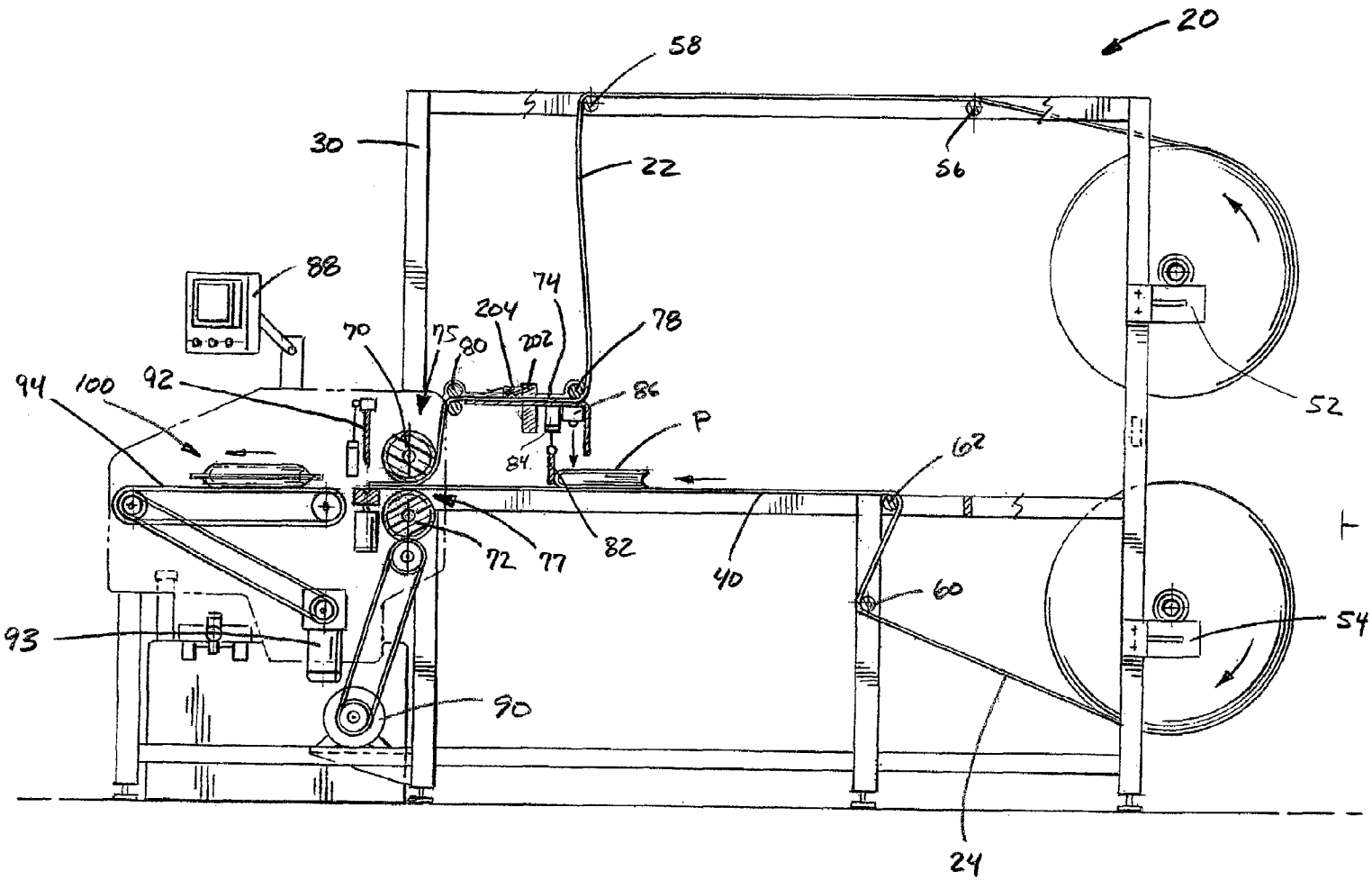
Figure 4:
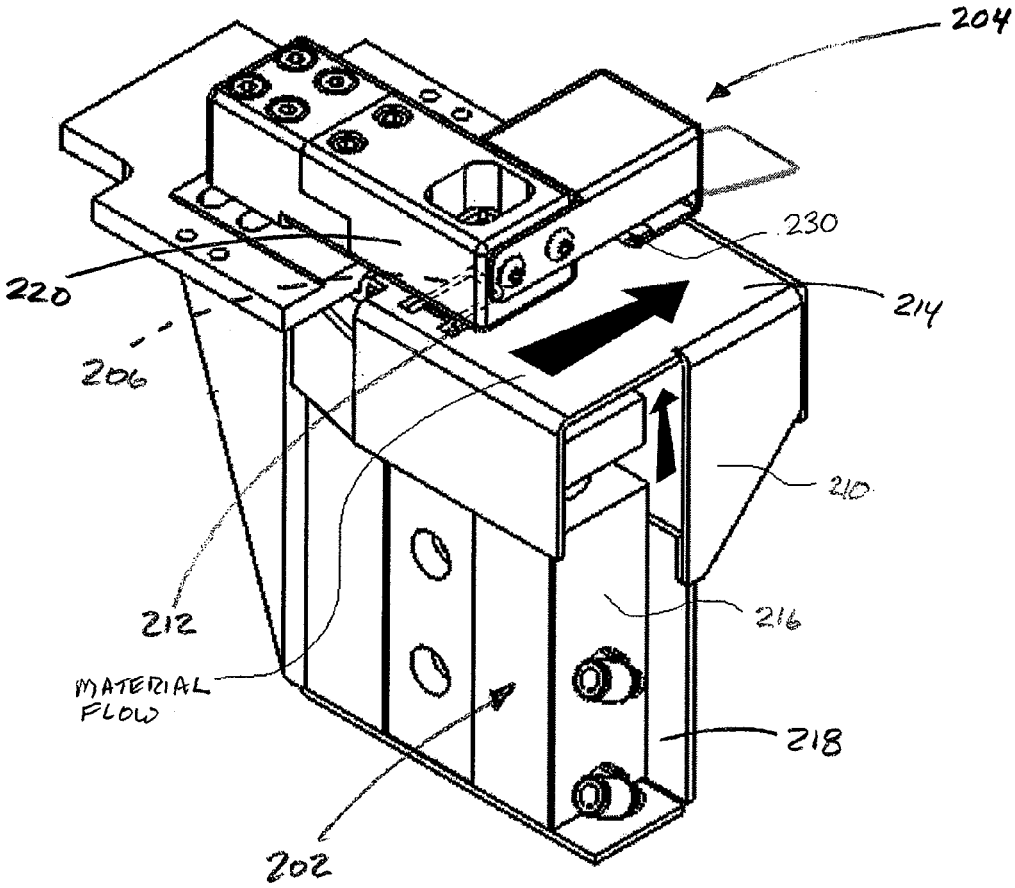
Figure 5:
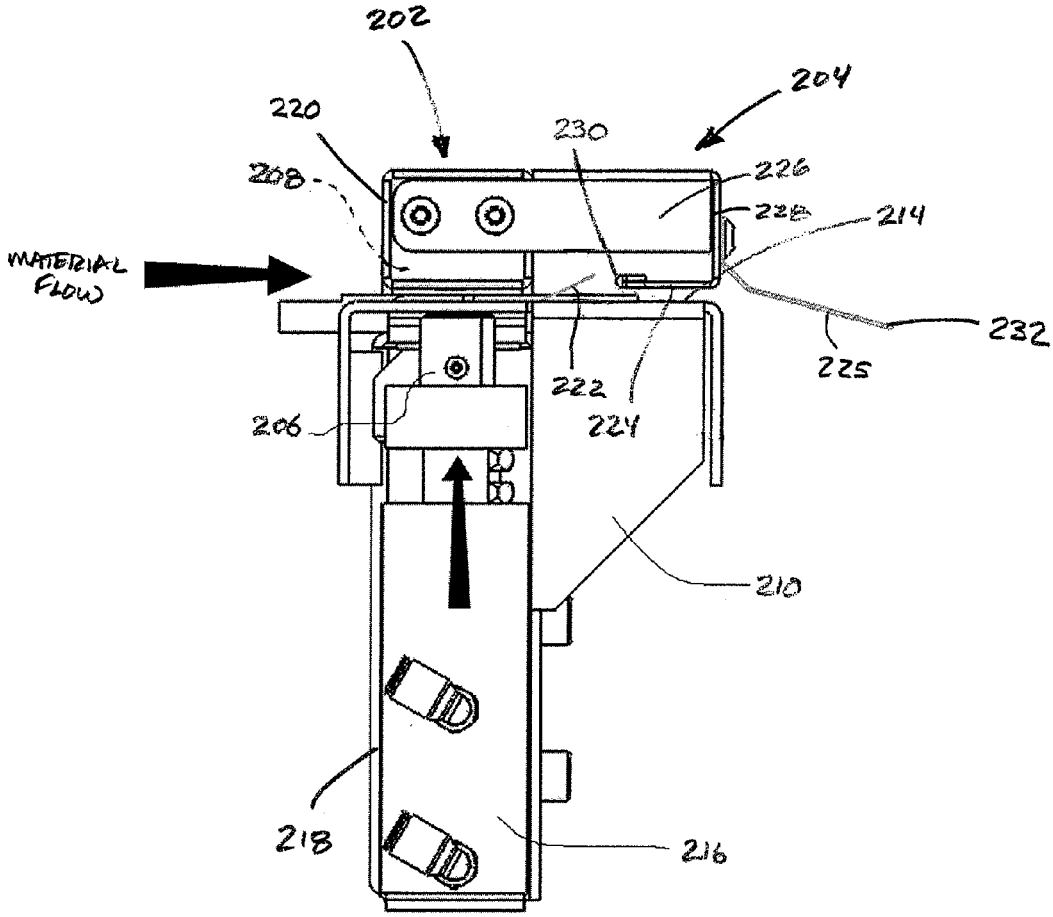
Figures 6, 6A:
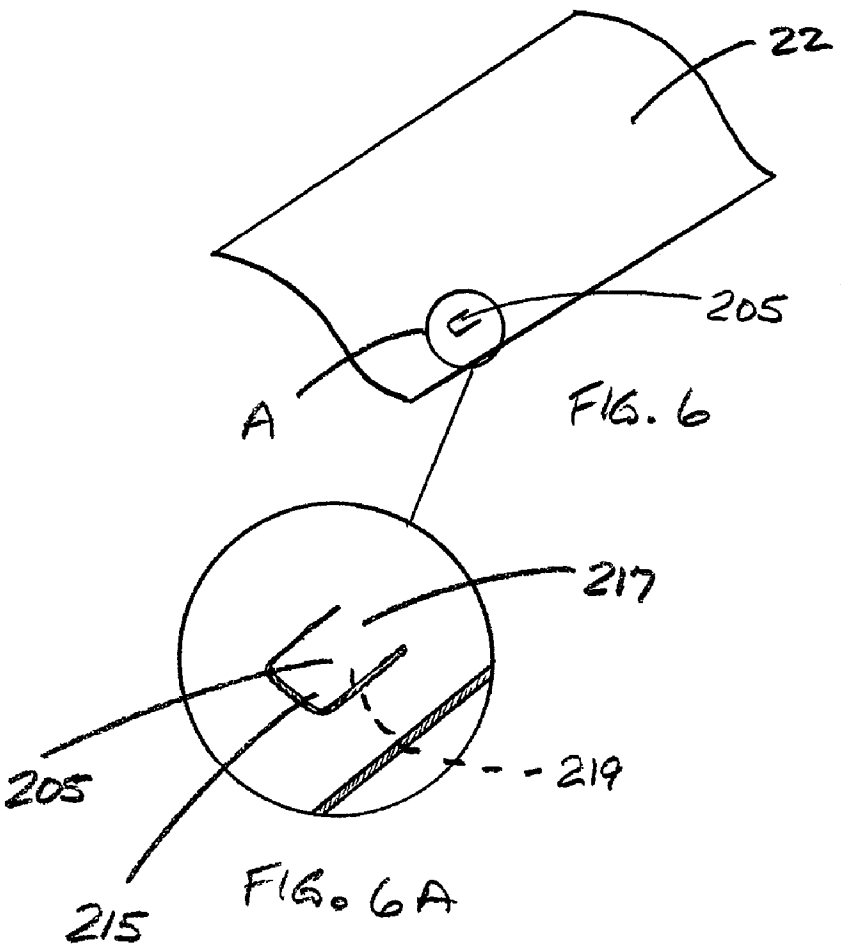
Figures 7, 7A:
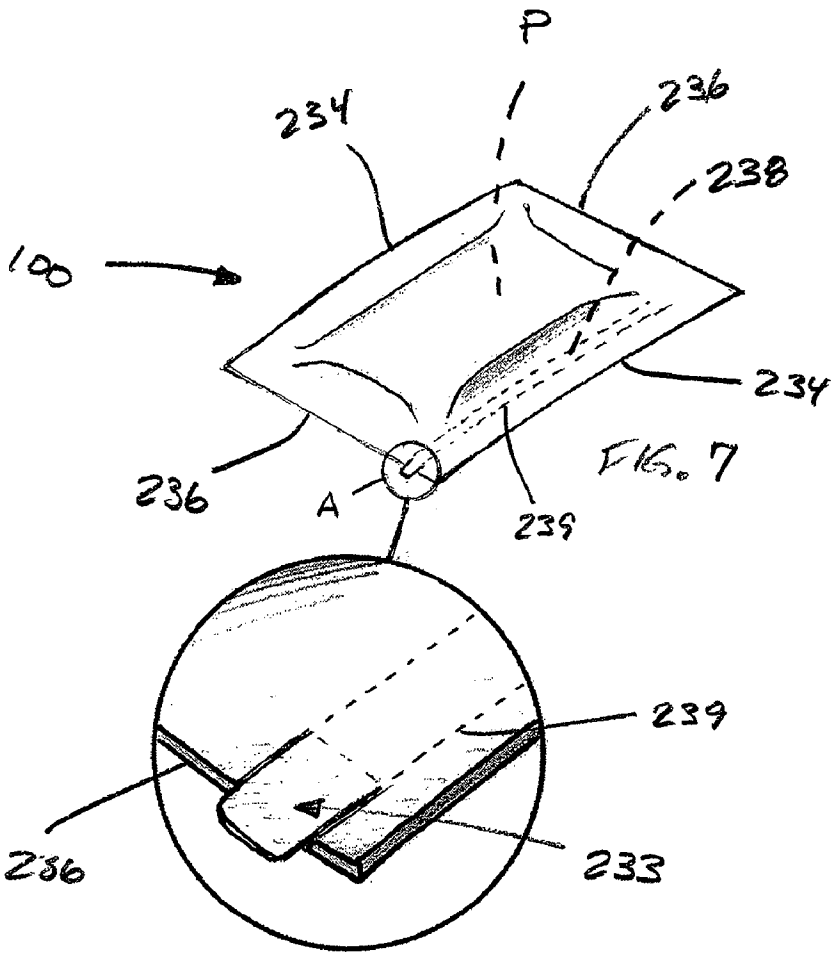
Figures 8, 8A, 9, 10:
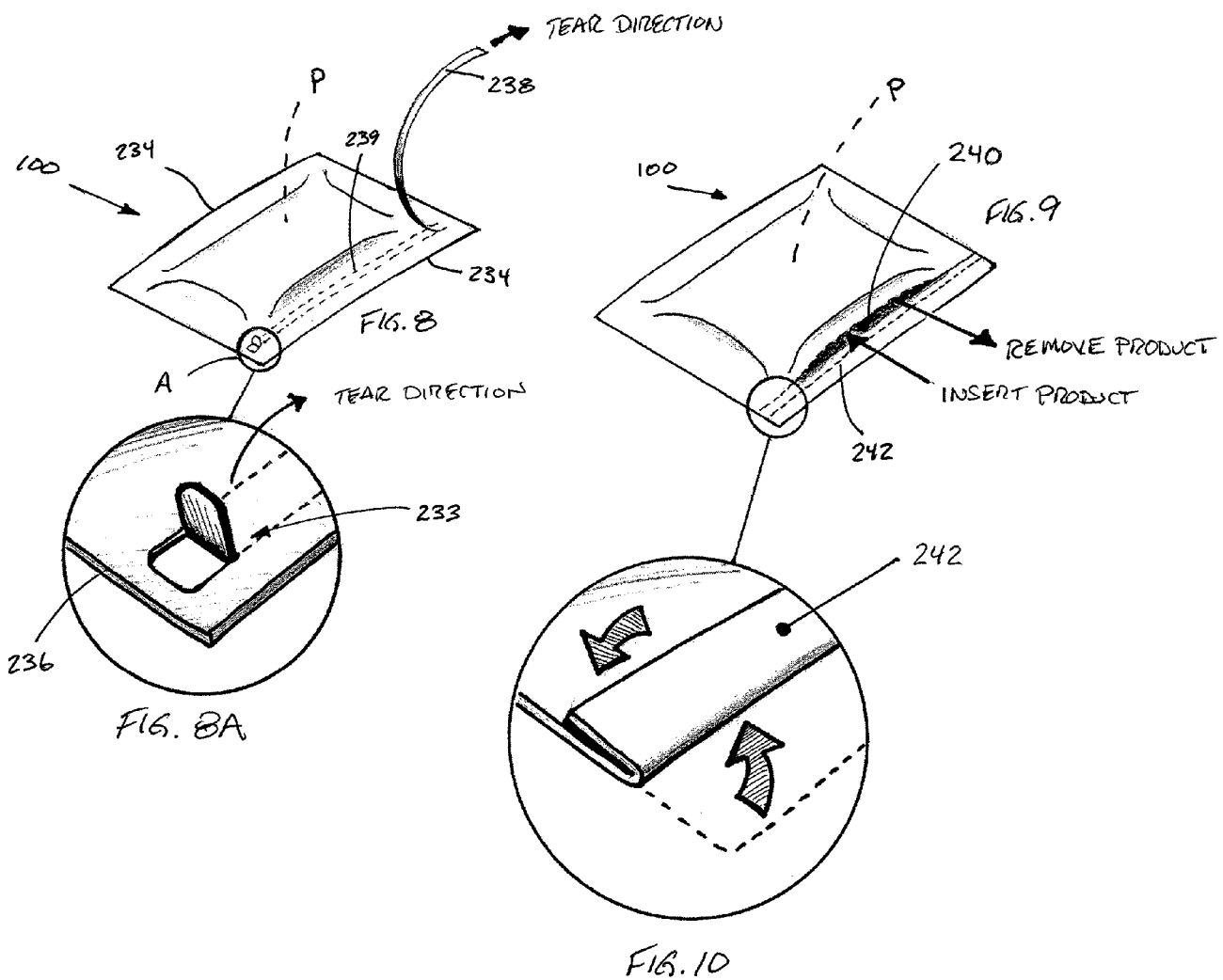
Figure 11:
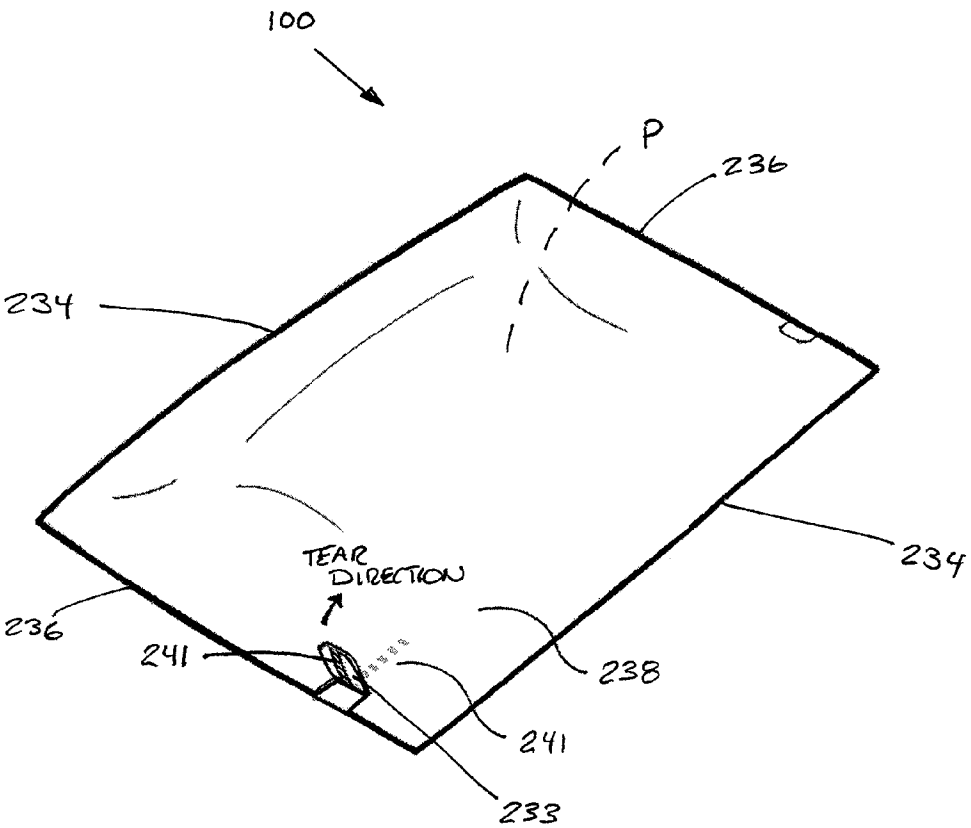
Figure 12:
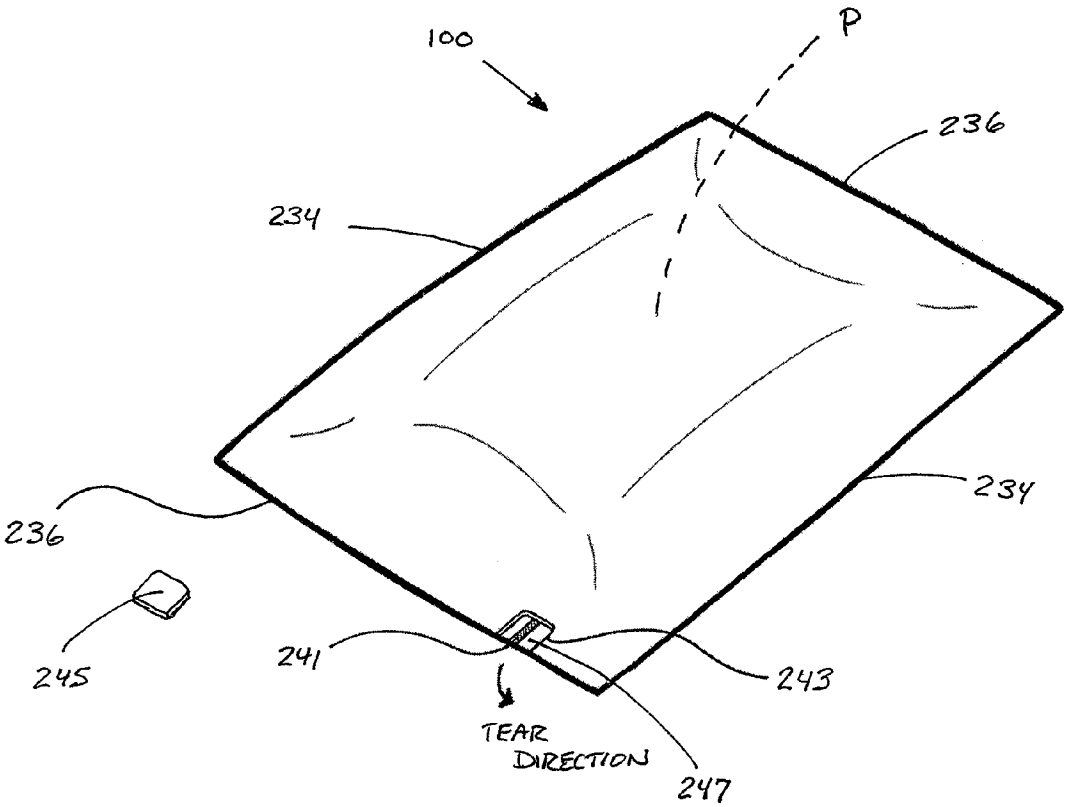
Figure 13:
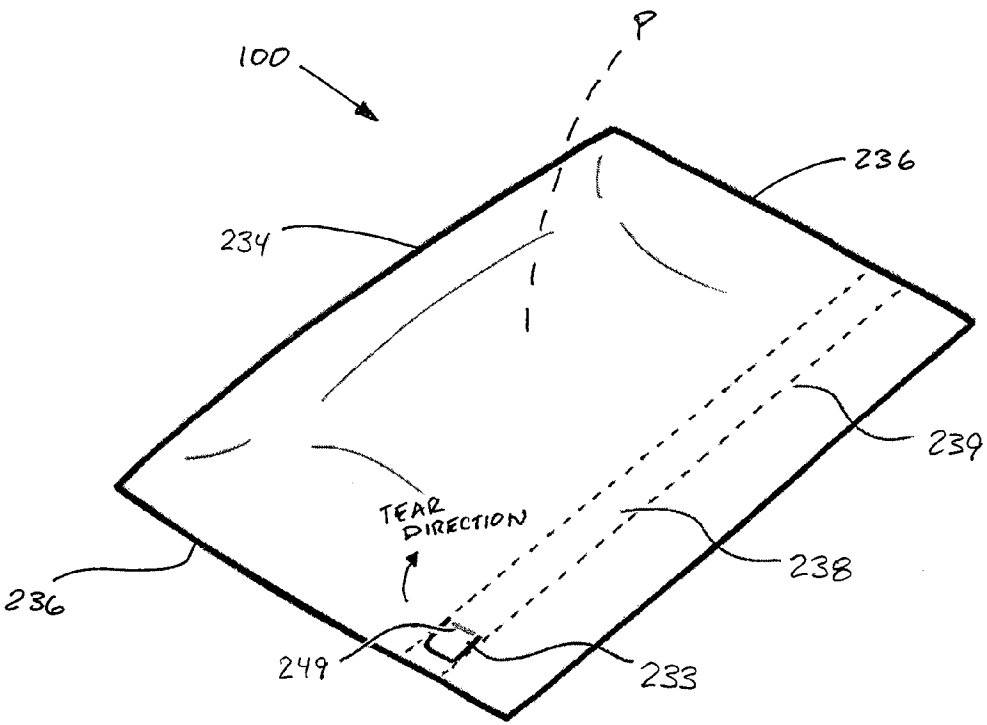

Having thus described the invention in general terms, reference will now be made to the accompanying drawings, which are not necessarily drawn to scale, and wherein:

FIG. 1 is a perspective view of a packaging apparatus in accordance with one embodiment of the invention;

FIG. 2 is a perspective view of a package formed by the packaging apparatus;

FIG. 3 is a side view of a packaging apparatus in accordance with an embodiment of the invention;

FIG. 4 is a perspective view of a notch former and tab setter of the packaging apparatus in accordance with one embodiment of the present invention;

FIG. 5 is a rear view of the notch former and tab setter shown in FIG. 4;

FIG. 6 is a perspective view of the first web having a notch formed therein by the notch former;

FIG. 6A is a detailed view showing the notch formed in the first web;

FIG. 7 is a perspective view of a package formed by the packaging apparatus;

FIG. 7A is a detailed view showing a tab formed by the notch former and tab setter;

FIG. 8 is a perspective view of a package formed by the packaging apparatus showing removal of a tear strip;

FIG. 8A is a detailed view showing a tab of the package;

FIG. 9 is a perspective view showing an opened package with the tear strip removed;

FIG. 10 is a detailed view showing a flap of the package being folded over in order to use the package for re-mailing;

FIG. 11 is a perspective view of a package in accordance with one embodiment of the present invention showing tear tape attached to a tab;

FIG. 12 is a perspective view of a package in accordance with one embodiment of the present invention showing a cutout area that creates an exposed area; and FIG. 13 is a perspective view of a package in accordance with one embodiment of the present invention showing a tab formed from first and second webs and having a transverse cut.

DETAILED DESCRIPTION OF THE INVENTION

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

A packaging apparatus 20 in accordance with one embodiment of the invention is shown in FIG. 1. The apparatus 20 is of the dual-web type for advancing a first or upper web 22 and a second or lower web 24 in generally parallel opposing relation with a product P disposed between the webs 22, 24 and sealing the webs 22, 24 together to capture the product P therebetween. It should be noted that although the figures depict a single product P, for the purposes of this specification and the appended claims, the term product may refer to a single product or multiple products.

The webs 22, 24 can comprise various materials such as, but not limited to, paper, paperboard, polymeric films, metal foil, polymeric foam, or combinations thereof. The apparatus 20 includes a main frame having a base formed by a plurality of spaced vertical support columns 26, 28, 30, on one side of a longitudinal axis of the apparatus, and a corresponding plurality of spaced vertical support columns 26', 28', 30' on the opposite side of the longitudinal axis. Upper and lower longitudinal members 32 are rigidly connected between support columns 26 and 28 and between support columns 28 and 30, and similar longitudinal members 32' are rigidly connected between columns 26' and 28' and between columns 28' and 30'. A lower transverse member 34 is rigidly connected between the support columns 30 and 30', a lower transverse member 36 is rigidly connected between the support columns 28 and 28', and a lower transverse member 38 is rigidly connected between the support columns 30 and 30'. A generally planar infeed bed 40 is rigidly connected between the longitudinal members 32, 32'. A lower longitudinal member 42 is rigidly connected between the lower transverse members 36 and 38.

The main frame also includes a superstructure that extends up from the base and above the infeed bed 40. The superstructure is formed by upward extensions of the support columns 26, 26', 30, and 30'. An upper transverse member 44 is rigidly connected between the upper ends of the columns 26 and 26'. An upper longitudinal member 48 is rigidly connected between the upper ends of the columns 26 and 30, and an upper longitudinal member 50 is rigidly connected between the upper ends of the columns 26' and 30'.

Upstream columns 26 and 26' support web mounts 52, 54 that respectively support supply rolls of the webs 22, 24 in a rotatable manner. The upper web 22 is drawn from its supply roll and advanced over a guide 56 supported between the longitudinal members 48, 50, then over a guide 58 supported between the longitudinal members 48, 50 and spaced longitudinally downstream from the first guide 56, and then downward for further handling as described in detail below. The lower web 24 is drawn from its supply roll and advanced under a lower guide 60 supported between columns 28, 28', then over an upper guide 62 supported between columns 28, 28', then onto the upper surface of the infeed bed 40. The infeed bed 40 supports a pair of web edge guides 64, 66 that extend parallel to the longitudinal axis of the machine and are spaced apart by a distance about equal to the width of the lower web 24. The edge guides 64, 66 capture the opposite edges of the web 24 between the infeed bed 40 and the guides 64, 66 and thereby hold the lower web 24 flat on the infeed bed 40 and substantially prevent transverse movement of the web 24, while allowing the web 24 to freely move in the longitudinal direction. A product P to be packaged is placed upon the lower web 24 on the infeed bed 40, as further described below.

With reference to FIGS. 1 and 3, the apparatus 20 includes a pair of rollers 70, 72 that are rotatably mounted in the main frame at a downstream end thereof. The rollers 70, 72 form a sealing, nipping or packaging station 75 at which the webs 22, 24 are sealed together to enclose the product P. Advantageously, one or both of the rollers 70, 72 comprises a resiliently deformable material at least over a medial portion of the roller's length, such that the passage of the product P through a nip 77 deforms the roller(s) 70, 72 and the restoring force of the resiliently deformable material presses the webs 22, 24 toward each other so that the webs 22, 24 conform closely to the product P. The webs 22, 24 advantageously have a layer of cold seal or cohesive material on their facing surfaces such that the application of pressure by the rollers 70, 72 causes the webs 22, 24 to adhere to each other but not to the product P. Thus, the webs do not stick to the object being packaged or to the components of the apparatus 20 with which the webs come into contact as they pass through the apparatus. The cohesive may be applied to a pre-manufactured web by any of various techniques, or the cohesive may be coextruded with the web during web manufacture. The end portions of each of the rollers 70, 72 advantageously comprise a generally non-deformable material for firmly gripping the opposite edge portions of the webs 22, 24, and the rollers 70, 72 advantageously are rotatably driven for advancing the webs 22, 24 through the apparatus 20, thus comprising a web drive system. Alternatively, a separate web drive system can be employed if desired. Furthermore, other types of packaging stations can be used, such as non-resilient rollers that engage edge portions of the webs 22, 24 to seal them together, heat-sealing devices for heat-sealing the webs together and others.

At a downstream end of the infeed bed 40, an upper web support plate 74 is mounted between a pair of spaced end plates 76, forming a housing that rests atop the base of the main frame. This housing preferably is pivotable relative to the main frame about hinges on a corner of the housing, for access to internal parts of the machine when required for maintenance and the like. The upper web support plate 74 is spaced vertically above the level of the infeed bed 40. The upper web 22 is advanced beneath a pair of longitudinally spaced web guides 78, 80 supported atop the end plates 76, such that the upper web 22 passes along the upper surface of the support plate 74. The support plate 74 provides support for the upper web 22 so that an adhesive label can be affixed to the web 22 either by hand or by a labeling unit.

As best seen in FIG. 3, the apparatus 20 includes an infeed gate 82 suitably mounted (such as below the upper web support plate 74) in a position upstream of the nip 77 defined by the rollers 70, 72. The infeed gate 82 is connected to an actuator 84, such as a pneumatic cylinder or the like, operable to move the infeed gate 82 between a blocking position wherein the lower edge of the gate 82 abuts or nearly abuts the lower web 24 on the infeed bed 40 and an unblocking position wherein the lower edge of the gate 82 is spaced above the lower web 24 by a distance exceeding a maximum height of the products P to be packaged such that the products P can pass beneath the gate 82. Thus, when a package is to be formed, the infeed gate 82 is lowered to the blocking position and the product P is placed on the lower web 24 with the leading edge of the product P abutting the gate 82. This ensures that the leading edge of the product P is in a consistent, repeatable location with respect to the nip 77.

The apparatus 20 may also include a product-sensing detector 86 for detecting the presence of a product P on the lower web 24 at the infeed gate 82. The product detector 86 is located at or downstream of the product placement location. For example, the product detector 86 may be mounted above the lower web just upstream of the infeed gate 82. The detector 86 is positioned such that it has a direct line of sight to the lower web 24 as long as no product P is on the web 24, but so that the line of sight is blocked by any product P present on the web 24. The product detector 86 can comprise various types of devices, including, but not limited to, a sensor trained or calibrated to detect a specific color or illuminance. Examples of available sensors that may be used are the Keyence CZ-40 Digital Fiber-optic Sensor with a CZ-KLP amplifier, or the EMX UVX 300, the former being a color sensor and the latter a luminescence sensor.

As noted, the apparatus 20 may also include a system controller 88. The controller 88 can be programmed to control the various motors and actuators of the apparatus 20 that effect movement of the moving parts. In particular, the controller 88 is connected to a motor 90 that drives the nip rollers 70, 72, to a cutoff device 92, to a motor 93 that drives an out-feed conveyor 94, and to an actuator 84 for the infeed gate 82. The controller 88 is also connected to the product detector 86 and receives a signal therefrom.

As shown in FIGS. 1 and 3, the packaging apparatus 20 also advantageously includes a notch former 202 and a tab setter 204. In the depicted embodiment, the notch former 202 is located adjacent the first web 22 and upstream from the cutoff device 92. As the first web 22 advances past the notch former 202, a notch 205 is created in the first web 22. Once joined with the second web 24 and severed by the cut off device 92 to create a package 100 surrounding a product P, the notch 205 becomes a tab that may be used to tear through the first web 22 in order to easily open the package 100 and access the product P. It should be noted that although the depicted embodiment shows the notch former 202 adjacent the first web 22 in order to create a notch in the first web 22, in other embodiments, a notch former may be located adjacent the second web 24 to create a notch in the second web 24. In still other embodiments, a notch former may be positioned adjacent adhered first and second webs 22, 24 to create a notch in both webs. Additionally, multiple notch formers could be employed to create notches in various locations of either or both the first and second webs 22, 24.

FIGS. 4 and 5 show the notch former 202 and tab setter 204 of the depicted embodiment in more detail. In the depicted embodiment, the notch former 202 includes a linearly actuateable notch blade 206 that strikes against a blade striking member 208. The notch blade 206 and the blade striking member 208 are positioned on opposite sides of the first web 22 such that when actuated, the notch blade 206 forms a notch in the first web 22. The first web 22 travels in the material flow direction indicated by the arrow past the notch former 202. In the depicted embodiment, the first web 22 is supported vertically by a web support bracket 210. The notch blade 206 of the depicted embodiment is a U-shaped steel blade that is capable of cutting through the various materials that may be used for the packaging material webs, including, but not limited to, paper, paperboard, polymeric films, metal foil, polymeric foam, or combinations thereof. As shown in FIG. 4, the web support bracket 210 includes a cutout section 212 that is configured to allow the U-shaped notch blade 206 to pass from a resting position, below a top surface 214 of the web support bracket 210, up to the blade striking member 208. Although the depicted notch former 202 uses a notch blade 206 to create the notch, other embodiments may use other devices to create a notch including, but not limited to, wire cutting devices, milling devices, or laser cutting devices. Additionally, the shape of the notch need not be U-shaped, and in other embodiments may be any other shape that may form a tab such as, but not limited to, C-shaped, D-shaped, or V-shaped.

The notch blade 206 is actuated by an actuating device 216 that is housed in an actuator bracket 218. In the depicted embodiment, the actuating device 216 is an air cylinder controlled by the controller 88. In other embodiments, the actuating device 216 may be any device structured to actuate the notch blade 206 to strike the blade striking member 208. In the depicted embodiment, when the air cylinder receives an actuating signal from the controller 88, the air cylinder drives the notch blade 206 from a resting position toward the blade striking member 208. As noted above, the first web 22 passes between the notch blade 206 and the blade striking member 208. When the notch blade 206 is driven toward the blade striking member 208, it presses the first web 22 against the blade striking member 208 until the notch blade 206 slices through the first web 22 to create a notch 205 having a shape created by the profile of the notch blade 206. The actuating device 216 then returns the notch blade 206 back to its resting position. As a result, a notch 205 is formed in the first web 22. The notch 205 includes a free end 215 and an anchored end 217 that is attached to the remaining first web 22. FIGS. 6 and 6A depict a section of the first web 22 showing the notch 205 created in the first web 22.

In the depicted embodiment, the process of actuating the notch blade 206 from its resting position to the blade striking member 208 and returning the notch blade 206 to its resting position is performed in a relatively short period of time, which allows the first web 22 to continue to advance past the notch former 202 and toward the packaging station 75. In the depicted embodiment, the blade striking member 208 is a rubber insert that is housed in a striking member housing 220. In other embodiments, however, the blade striking member 208 may be constructed of any material structured to aid the notch blade 206 in creating a notch in the web. The striking member housing 220 is located above the web support bracket 210 such that the first web 22 passes between the web support bracket 210 and the striking member housing 220 in the material flow direction indicated by the arrow.

The inventors of the present invention have determined that once a notch is created in a web, in some embodiments it may be advantageous to set the notch, such as by creating a notch that extends away from the web material downstream from the notch former 202. For example, it may be advantageous to bias the notch 205 to one side of the first web 22 and set the notch 205 away from the web material so that it may create an easy to use tab. Setting the notch 205 may also be advantageous such that it does not interfere with the cutoff device 92 in order to create a tab having a length that extends beyond a longitudinal edge of the package 100. In some embodiments, it may also be advantageous to set the notch in order to bias a tab created in one web, which has cohesive material on its facing surface, away from the other web, which also has cohesive material on its facing surface, such that the tab extends away from, and is less likely to stick to, the other web. It should be noted that this concern may also be addressed by creating a tab that extends beyond a longitudinal edge of the package.

The depicted embodiment of the present invention also includes a tab setter 204 located downstream from the notch former 202. The tab setter 204 is structured to fold the free end 215 of the notch 205 to one side of the first web 22 and back against the first web 22, as the first web 22 is advanced. In the depicted embodiment, the tab setter 204 folds the notch 205 to the blade striking member side of the first web 22, however, in other embodiments the tab setter may fold the notch 205 to either side of the first web 22.

As best shown in FIG. 5, the tab setter 204 of the depicted embodiment includes a biasing member 222, a deflecting member 224, and a flattening member 225. The biasing member 222 is structured to bias the free end of the notch to one side of the web. In the depicted embodiment, the biasing member 222 is a flexible piece of spring steel that is aligned in a transverse direction with the position of the notch blade 206. The biasing member 222 forms an upward angle, directed away from the top surface 214 of the web support bracket 210 and toward the blade striking member side of the first web 22. As a result, after the notch blade 206 is actuated to create the notch 205 in the first web 22 and the first web 22 is advanced, the biasing member 222 forces the free end 215 of the notch 205 to one side of the remaining first web 22 before the notch 205 is deflected by the downstream deflecting member 224. Although in the depicted embodiment, the biasing member 222 is constructed of a flexible piece of spring steel, in various other embodiments the biasing member 222 may be any structure or device that is capable of biasing the notch 205 to one side of the web, including but not limited to other flexible structures of various materials, or other devices that may be actuated to bias the notch 205. Additionally, in various other embodiments, the angle of the biasing member 222 with respect to the top surface 214 of the web support bracket 210 and the position of the biasing member 222 with respect to the notch blade 206 may vary depending on the speed of the web drive system and the characteristics of the material chosen for the web.

The deflecting member 224 is located downstream from the biasing member 222. The deflecting member 224 is structured such that as the first web 22 advances, carrying the notch 205 past the biasing member 222, the deflecting member 224 causes the free end 215 of the notch 205 to rotate to a position in which the free end 215 is directed in an approximate upstream direction and substantially adjacent the first web 22. In the depicted embodiment, the deflecting member 224 is a stationary piece of steel that extends from a tab setting bracket 226. The tab setting bracket 226 is attached to the striking member housing 220 and is a hollow box-shaped steel structure that is located on the blade striking member side of the first web 22. The tab setting bracket 226 extends from the striking member housing 220 in the downstream direction. The deflecting member 224 is a steel plate that extends in the upstream direction from a downstream end 228 of the tab setting bracket 226, substantially parallel to the top surface 214 of the web support bracket 210 such that it terminates at a deflecting end 230. The deflecting end 230 of the deflecting member 224 is located on the blade striking member side of the top surface 214 of the web support bracket 210, approximately adjacent, but downstream from the biasing member 222. In the depicted embodiment, the deflecting end 230 of the deflecting member 224 has a rounded profile so that the free end 215 of the notch 205 will easily deflect off of the deflecting end 230 as the web is advanced. Although in the depicted embodiment, the deflecting member 224 is constructed of a stationary steel plate, in various other embodiments the deflecting member 224 may be any structure or device that is capable of deflecting the free end 215 of the notch 205 to cause the free end 215 to rotate to a position in which it is directed in an approximate upstream direction and substantially adjacent the first web 22, including but not limited to, stationary structures of various materials, rollers, or other devices that may be actuated to deflect the notch 205. Additionally, in various other embodiments, the distance between the deflecting end 230 and the biasing member 222, as well as the relative position of the deflecting end 230 with respect to the top surface 214 of the web support bracket 210 may vary depending on the speed of the web drive system and the characteristics of the material chosen for the web.

In some instances, such as the depicted embodiment, it may advantageous to further control the free end 215 of the notch 205. In such embodiments, a flattening member 225 is also included as part of the tab setter 204. The flattening member 225 is structured to flatten the notch 205 back against the first web 22 as the first web 22 is advanced. In the depicted embodiment, the flattening member 225 is a formed piece of flexible spring steel that extends from the tab setting bracket 226 on the blade striking member side of the first web 22, in a downstream direction from the deflecting member 224. The flattening member 225 extends toward the top surface 214 of the web support bracket 210 and terminates at a flattening end 232. As such, as the first web 22 is advanced the flattening member 225 effectively creates a crease at the anchor end 217 of the notch 205. Although in the depicted embodiment, the flattening member 225 is constructed of a flexible spring steel piece, in various other embodiments the flattening member may be any structure or device that is capable of flattening the notch 205 against the first web 22, including, but not limited to, other flexible structures of various materials, rollers, or other devices that may be actuated to flatten the notch 205 against the first web 22 as the web is advanced. Additionally, in various other embodiments, the distance between the flattening end 232 and the deflecting member 224, as well as the position of the flattening end 232 with respect to the top surface 214 of the web support bracket 210 and the magnitude of the force exerted on the web material, may vary depending on the speed of the web drive system and the characteristics of the material chosen for the web.

Referring to FIGS. 1-8A, the process for creating a tab 233 on a package 100 using the notch former 202 and tab setter 204 of the present invention may be understood. As the first web 22 advances in the material flow direction, the actuating device 216 causes the notch blade 206 to move from its resting position and strike the blade striking member 208, thus slicing through the first web 22, and creating a notch 205 in the shape of the notch blade 206. The actuating device 216 returns the notch blade 206 to its resting position, allowing the first web 222 to continue to advance in the material flow direction. As the first web 22 advances downstream, a bottom surface 219 of the newly formed notch 205 travels along the biasing member 222, thus lifting the free end 215 of the notch 205 away from the top surface 214 of the web support bracket 210. As the first web 22 continues to advance downstream, a bottom surface 219 of the notch 205 contacts the deflecting end 230 of the deflecting member 224. The deflecting end 230 of the deflecting member 224 then causes the free end 215 of the notch 205 to rotate to a position in which it is directed in an approximate upstream direction. As the web continues to advance, the bottom surface 219 of the notch 205, which is now rotated, then travels along the length of the deflecting member 224 thus maintaining the notch 205 in an upstream directed folded position. As the free end 215 of the notch 205 travels past the deflecting member 224, it contacts the flattening member 225, which exerts a force on the folded notch 205, beginning at the anchored end 217 and continuing through the free end 215. As the first web 22 continues the advance, the free end 215 of the notch 205 travels past the flattening end 232 and the notch extends away from the first web 22.

Depending on the cross-machine position of the notch former 202, a packaging apparatus 20 that includes the above mentioned notch former 202 and tab setter 204 is capable of forming a tab 233 in any transverse location of a package 100. Referring to FIGS. 7-8A, in many cases it may be advantageous to form a tab 233 adjacent one of the two the transverse edges 234 of the package 100 to facilitate access to the product P inside the package 100. Additionally, the notch former 202 and tab setter 204 described above are also capable of forming a tab 233 at any longitudinal location of a package 100. Referring again to FIGS. 7-8A, in many cases it may also be advantageous to create a tab 233 adjacent a longitudinal edge 236 of the package 100 to facilitate access to the product P inside the package 100. By locating the tab 233 adjacent one of the two transverse edges 234 of the package 100 and adjacent the downstream longitudinal edge 236 of the package 100, access to the product P inside the package 100 is further facilitated by creating an easy to use tab 233 that creates a tear strip 238. To further facilitate access to the product P in the package 100, it may also be advantageous to create a tab 233 having a length that extends beyond the longitudinal edge 236 of the package 100. In various embodiments, the package 100 may also include at least one perforation line 239 extending from the tab 233. It should be noted that in other embodiments, such as that shown in FIG. 11, it may also be advantageous to include tear tape 241 that is attached to a tab 233 and that extends along a length of a package 100 to create a tear strip 238 to facilitate opening the package 100. The tear tape 241 may be located between the webs, as shown in the FIG. 11, or may be located on an outside surface of the package 100. The tear tape 241 may be constructed of any material known in the art to aid in the opening of a package, including, but not limited to, polymeric materials, reinforced tapes, fiber strings, and other relatively strong materials.

Referring to FIG. 3, in order to form a tab 233 that is adjacent a longitudinal edge 236 of the package 100, the timing of the actuation of the notch former 202 is controlled by the controller 88 in conjunction with the control of the infeed gate 82 and the cutoff device 92. When a package 100 is to be formed, the infeed gate 82 is lowered to the blocking position and the product P is placed on the second web 24 with the leading edge of the product P abutting the gate 82. This ensures that the leading edge of the product P is in a consistent, repeatable location with respect to the nip 77 of the packaging station. Given the known location of the product P with respect to the nip 77, the controller 88 controls the timing of the actuation of the notch former 202 and the cutoff device 92 such that the tab 233, in the depicted embodiment, is located adjacent a downstream longitudinal edge 236 of the package. Because the tab setter 204 sets the notch 205, creating a notch 205 that extends away from the web material, the notch 205 does not interfere with the cutoff device 92 and a tab 233 having a length that extends beyond the downstream longitudinal edge 236 of the package 100 may be created as shown in FIGS. 7 and 7A.

Referring to FIGS. 8-10, by locating the tab 233 adjacent one of the two transverse edges 234 and adjacent a longitudinal edge 236 of the package 100 and by including a pair of perforation lines 239 extending from the tab 233, the tab 233 may create an easy to open tear strip 238 that forms a well-defined opening edge 240 when removed. FIG. 10 demonstrates that with the tear strip 238 removed, the remaining flap 242 of the package 100 may be folded over and secured in any known manner such that the package 100 that may be reused as a re-mailing package.

In another embodiment, such as that shown in FIG. 12, the notch former 202 may be used to create a cutout area 243 in either the first web 22 or the second web 24. In such embodiments, the notch blade 206 has a closed profile so that when activated as described above, it slices out a section 245 of the web. The section 245 may then be removed in any known manner. In the depicted embodiment, the cutout area 243 is formed adjacent a longitudinal edge 236 of the package 100 by controlling the timing of the activation of the notch former 202, the infeed gate 82, and the cutoff device 92 as similarly described above. An exposed area 247 of the second web 24 is created by the cutout area 243 and is used to open the package 100 by tearing in the direction shown. In the depicted embodiment, tear tape 241 is attached to the exposed area 247 to create a tear strip 238 that facilitates opening the package 100. In other embodiments, one or more perforation lines may extend from the exposed area 247 to facilitate opening the package 100.

FIG. 13 shows a package 100 in accordance with another embodiment of the present invention. The package 100 includes a tab 233 that is adjacent a longitudinal edge 236 and that includes a pair of perforation lines 239 located in the first web 22 that extend from the tab 233 to create a tear strip 238. In the depicted embodiment, the tab 233 is formed in both the first web 22 and the second web 24. As shown in FIG. 13, the tab 233 also includes a transverse cut 249 that is located on the second web 24. The transverse cut 249 may be made in any manner known in the art, including, but not limited to, using a linearly actuated slitter, similar to the notch former 202 described above. In the depicted embodiment, the tab 233 is not set away from the web. This may be advantageous, for example, in applications where the package 100 is subsequently processed by mailing equipment that may be sensitive to surface discontinuities. Tab 233 is used to open the package 100 by tearing in the direction indicated. The transverse cut 249 allows the tab 233 to break away from the second web 24 such that the tab 233 creates a tear strip 238 from the first web 22.

The package 100 shown in FIG. 13 may be created by locating a notch former adjacent a cutoff device such that the notch former slices through both the first web 22 and the second web 24 after the webs are adhered together. In another embodiment, the package 100 shown in FIG. 13 may be created by using a notch former adjacent the first web 22, and a second notch former adjacent the second web 24, and by controlling the timing of the activation of the notch formers, the infeed gate, and the cutoff device as similarly described above. As a result, individual notches formed by the respective notch formers may be aligned to create the double-thickness tab 233 shown in FIG. 13.

The present invention has several advantages by providing a product packaging apparatus 20 that includes a notch former 202 and a tab setter 204 for creating an integrated tab 233 or an exposed area 247 on a product package 100. By incorporating the tab 233 or the exposed area 247 into the packaging material, the apparatus and method of the present invention increase the ease of opening and aesthetic features of the package 100. The notch former 202 is capable of forming a tab 233 or an exposed area 247 at any location of the product package 100, including creating a tab 233 or an exposed area 247 adjacent a longitudinal edge 236 of the package 100. By including a tab setter 204, the present invention is further capable of creating tab 233 having a length that extends beyond the longitudinal edge 236 of the package 100. As a result, this creates a simple, easy to open package 100 that may also be re-used for re-mailing purposes.

Many modifications and other embodiments of the invention set forth herein will come to mind to one skilled in the art to which this invention pertain having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An apparatus for packaging a product in an easy to open package using continuous first and second webs of flexible packaging material, the apparatus comprising:

a packaging station comprising a nip through which the first and second webs with the product disposed therebetween are advanced in a longitudinal direction such that the webs are adhered to each other and envelop the product;

a web drive system operable to advance the first and second webs to the packaging station;

a cutoff device located downstream from the packaging station and structured to sever the adhered webs so as to create the package containing the product;

a notch former located upstream from the cutoff device and adjacent at least one of the first or second webs, structured to create a notch having a free end in at least one of the webs; and a tab setter located between the notch former and the cutoff device and structured to fold the free end of the notch back against the web before advancing through the cutoff device, thus forming a notch on the web that becomes a tab on the package for facilitating opening the package.

2. The apparatus of claim 1, wherein the notch former is located adjacent the first web and upstream from the packaging station such that the notch is formed in the first web.

3. The apparatus of claim 1, wherein the notch former comprises:

a linearly actuatable notch blade located adjacent and on one side of at least one of the first or second webs; and a blade striking member located adjacent and on the other side of the web such that the notch is created by actuating the notch blade toward the blade striking member.

4. The apparatus of claim 1, wherein the tab setter comprises:

a biasing member structured to bias the free end of the notch to one side of the web;

a deflecting member structured to rotate the free end of the notch to a position in which the free end is directed in an approximate upstream direction and substantially adjacent the web as the web is advanced; and a flattening member structured to flatten the notch against the web as the web is advanced.

5. The apparatus of claim 1 further comprising:

an infeed gate mechanism located adjacent the second web and upstream from the packaging station; and a controller for controlling the web drive system, the infeed gate mechanism, the notch former, and the cutoff device, wherein the infeed gate mechanism is structured to move between a blocking position for accurately positioning a leading edge of the product on the second web, and an unblocking position for allowing the product to travel with the second web to the packaging station, and wherein the controller controls the web drive system, the infeed gate, the notch former, and the cutoff device such that at least a portion of the tab extends beyond an edge of the package.

6. An apparatus for packaging a product in an easy to open package using continuous first and second webs of flexible packaging material, the apparatus comprising:

a packaging station comprising a pair of rollers forming a nip through which the first and second webs with a product disposed therebetween are advanced in a longitudinal direction such that the webs are adhered to each other and envelop the product;

a web drive system operable to advance the first and second webs to the packaging station;

a cutoff device located downstream from the packaging station and structured to sever the adhered webs so as to create the package containing the product;

an infeed gate mechanism located adjacent the second web and upstream from the packaging station and structured to move between a blocking position for accurately positioning a leading edge of the product on the second web, and an unblocking position for allowing the product to travel with the second web to the packaging station;

a notch former located upstream from the cutoff device and adjacent the first web, structured to create a notch having a free end in the first web, the notch former comprising:

a linearly actuatable notch blade located adjacent and on one side of the first web; and a blade striking member located adjacent and on the other side of the first web such that the notch is created by actuating the notch blade toward blade striking member; and a tab setter located between the notch former and the cutoff device and structured to fold the free end of the notch back against the web before advancing through the cutoff device, the tab setter comprising:

a biasing member structured to bias the free end of the notch to a first side of the web;

a deflecting member structured to rotate the free end of the notch to a position in which the free end is directed in an approximate upstream direction and substantially adjacent the web as the web is advanced; and a flattening member structured to flatten the notch against the web as the web is advanced, thus forming a notch on the web that becomes a tab on the package for facilitating opening the package; and a controller for controlling the web drive system, the infeed gate mechanism, the notch former, and the cutoff device, wherein the controller controls the web drive system, the infeed gate, the notch former, and the cutoff device such that at least a portion of the tab extends beyond an edge of the package for facilitating opening the package.

* * * * *